US008330586B2

(12) United States Patent
Krishnamoorthy et al.

(10) Patent No.: US 8,330,586 B2
(45) Date of Patent: Dec. 11, 2012

(54) SYSTEMS AND METHODS FOR PROGRAMMING OF A COOLING FAN VIA A SERIAL PORT COMMUNICATION MODE

(75) Inventors: Ravishanker Krishnamoorthy, Singapore (SG); Foo Leng Leong, Singapore (SG); Edy Susanto, Singapore (SG)

(73) Assignee: Marvell World Trade Ltd., St. Michael (BB)

( * ) Notice: Subject to any disclaimer, the term of this patent is extended or adjusted under 35 U.S.C. 154(b) by 248 days.

(21) Appl. No.: 12/707,910

(22) Filed: Feb. 18, 2010

(65) Prior Publication Data

US 2010/0215509 A1 Aug. 26, 2010

Related U.S. Application Data

(60) Provisional application No. 61/154,854, filed on Feb. 24, 2009.

(51) Int. Cl.
*G08C 15/08* (2006.01)
*G06F 9/24* (2006.01)
*F04B 49/00* (2006.01)

(52) U.S. Cl. ..... 340/13.21; 340/4.32; 318/268; 700/300

(58) Field of Classification Search ..... 318/268, 318/400.01, 400.04, 400.07, 599; 340/3.1, 340/3.3–3.32, 4.3–4.37, 13.21; 388/809–811; 700/299–300; 711/170, 173, 200, 209; 710/8–10; 361/676, 678

See application file for complete search history.

(56) References Cited

U.S. PATENT DOCUMENTS

| | | | | |
|---|---|---|---|---|
| 5,952,798 | A * | 9/1999 | Jones et al. | 318/268 |
| 6,236,175 | B1 * | 5/2001 | Mourad et al. | 318/268 |
| 6,392,372 | B1 * | 5/2002 | Mays, II | 318/400.01 |
| 6,545,438 | B1 * | 4/2003 | Mays, II | 318/400.01 |
| 6,563,284 | B2 * | 5/2003 | Teutsch et al. | 318/599 |
| 6,697,254 | B1 * | 2/2004 | King et al. | 361/679.48 |
| 6,836,834 | B2 * | 12/2004 | Schulze et al. | 711/200 |
| 7,990,087 | B2 * | 8/2011 | Artman et al. | 318/400.07 |
| 8,032,261 | B1 * | 10/2011 | Beauchamp et al. | 700/299 |
| 2002/0120367 | A1 * | 8/2002 | Emberty et al. | 700/282 |
| 2004/0186629 | A1 * | 9/2004 | Frankel et al. | 700/300 |
| 2005/0171648 | A1 * | 8/2005 | Frankel et al. | 700/300 |
| 2005/0254799 | A1 * | 11/2005 | Murara et al. | 388/809 |
| 2006/0152891 | A1 * | 7/2006 | Jreij et al. | 361/676 |
| 2006/0181231 | A1 * | 8/2006 | Pintado et al. | 318/254 |
| 2007/0200518 | A1 * | 8/2007 | Verge | 318/268 |
| 2009/0082908 | A1 * | 3/2009 | Green | 700/276 |

* cited by examiner

*Primary Examiner* — Benjamin C Lee
*Assistant Examiner* — Stephen Burgdorf

(57) ABSTRACT

Embodiments of the present disclosure provide a method that comprises, based upon receipt of a mode command, changing an operating mode of a fan motor controller of a fan to a serial port communication protocol, programming a memory of the fan motor controller with an operating parameter of the fan, and based upon receipt of a serial port command, changing the operating mode of the fan motor controller from the serial port communication protocol to another protocol.

17 Claims, 2 Drawing Sheets

SYSTEMS AND METHODS FOR PROGRAMMING OF A COOLING FAN VIA A SERIAL PORT COMMUNICATION MODE

CROSS REFERENCE TO RELATED APPLICATIONS

The present application claims priority to U.S. Provisional Patent Application No. 61/154,854, filed Feb. 24, 2009, the entire specification of which is hereby incorporated by reference in its entirety for all purposes, except for those sections, if any, that are inconsistent with this specification.

TECHNICAL FIELD

Embodiments of the present disclosure relate to managing operating parameters for cooling fans, and more particularly, to programming of a cooling fan with operating parameters via a serial port communication mode.

BACKGROUND

Fans have been used as a part of cooling systems for electronic devices for a long time. The fans can be of all form factors, at different locations, and with different configurations within the cooling system. Fans are used to prevent overheating of the systems and components within the electronic devices, which might lead to catastrophic failure of the electronic devices.

A typical fan available in today's market includes a fan motor and a fan motor controller to allow the fan motor to spin up correctly and maintain speed. Different fan motor controllers are required for different fans due to the fact that fan motors of different form factors will have different parameters, such as, for example, inertia, inductance and resistance. Additionally, fans and their fan motors may be used in numerous applications, each of which might require different parameters such as, for example, minimum speed, top speed and speed versus temperature variation. However, there is no one fan motor controller that can handle the varying requirements and operating parameters for most, if not all, of the fan motors in the market. Thus, different fan motor controllers must be used for different fan motors depending upon the requirements of the electronic device within which the fan will ultimately be used. This makes inventories of electronic device manufacturers and fan manufacturers more difficult to maintain.

The description in this section is related art, and does not necessarily include information disclosed under 37 C.F.R. 1.97 and 37 C.F.R. 1.98. Unless specifically denoted as prior art, it is not admitted that any description of related art is prior art.

SUMMARY

The present disclosure provides a method that comprises, based upon receipt of a mode command, changing an operating mode of a fan motor controller of a fan to a serial port communication protocol, programming a memory of the fan motor controller with an operating parameter of the fan, and based upon receipt of a serial port command, changing the operating mode of the fan motor controller from the serial port communication protocol to another protocol.

In accordance with an embodiment, the fan comprises a three-wire control arrangement, and the serial port communication protocol is a one-wire serial port communication protocol.

In accordance with an embodiment, the fan comprises a four-wire control arrangement, and the serial port communication protocol is a two-wire serial port communication protocol.

In accordance with an embodiment, the operating parameter is selected to adapt performance of the fan to accommodate an electronic device.

The present disclosure also provides an apparatus that comprises a power input, a ground input, a monitor pin, and a control module. The control module is configured to, in response to receipt of a mode command at the monitor pin, change an operating mode of the apparatus to a serial port communication protocol, program a memory of the apparatus with an operating parameter of a fan, and, in response to receipt of a serial port command at the monitor pin, change the operating mode of the apparatus from the serial port communication protocol to another protocol.

In accordance with an embodiment, the apparatus further comprises a pulse width modulation (PWM) pin, wherein the serial port communication protocol is a two-wire serial port communication protocol, and wherein the control module is configured to utilize the monitor pin and the PWM pin for the two-wire serial port communication protocol.

In accordance with an embodiment, the control module is configured to program multiple operating parameters of the fan into the memory.

BRIEF DESCRIPTION OF THE DRAWINGS

Embodiments of the present disclosure will be readily understood by the following detailed description in conjunction with the accompanying drawings. To facilitate this description, like reference numerals designate like structural elements. Embodiments herein are illustrated by way of example and not by way of limitation in the figures of the accompanying drawings.

DETAILED DESCRIPTION

Embodiments of the present disclosure describe systems and methods for inter-cluster interference management in coordinated cellular networks. In the following detailed description, reference is made to the accompanying drawings which form a part hereof, wherein like numerals designate like parts throughout. It is to be understood that other embodiments may be utilized and structural or logical changes may be made without departing from the scope of the present disclosure. Therefore, the following detailed description is not to be taken in a limiting sense, and the scope of embodiments is defined by the appended claims and their equivalents.

The description uses the phrases "in an embodiment," "in embodiments," or similar language, which may each refer to one or more of the same or different embodiments. Furthermore, the terms "comprising," "including," "having," and the like, as used with respect to embodiments of the present disclosure, are synonymous.

Various operations are described as multiple discrete operations in turn, in a manner that is most helpful in understanding the claimed subject matter. However, the order of description should not be construed as to imply that these operations are necessarily order dependent. In particular, these operations may not be performed in the order of presentation. Operations described may be performed in a different order than the described embodiment. Various additional operations may be performed and/or described operations may be omitted in additional embodiments.

Figure 1:
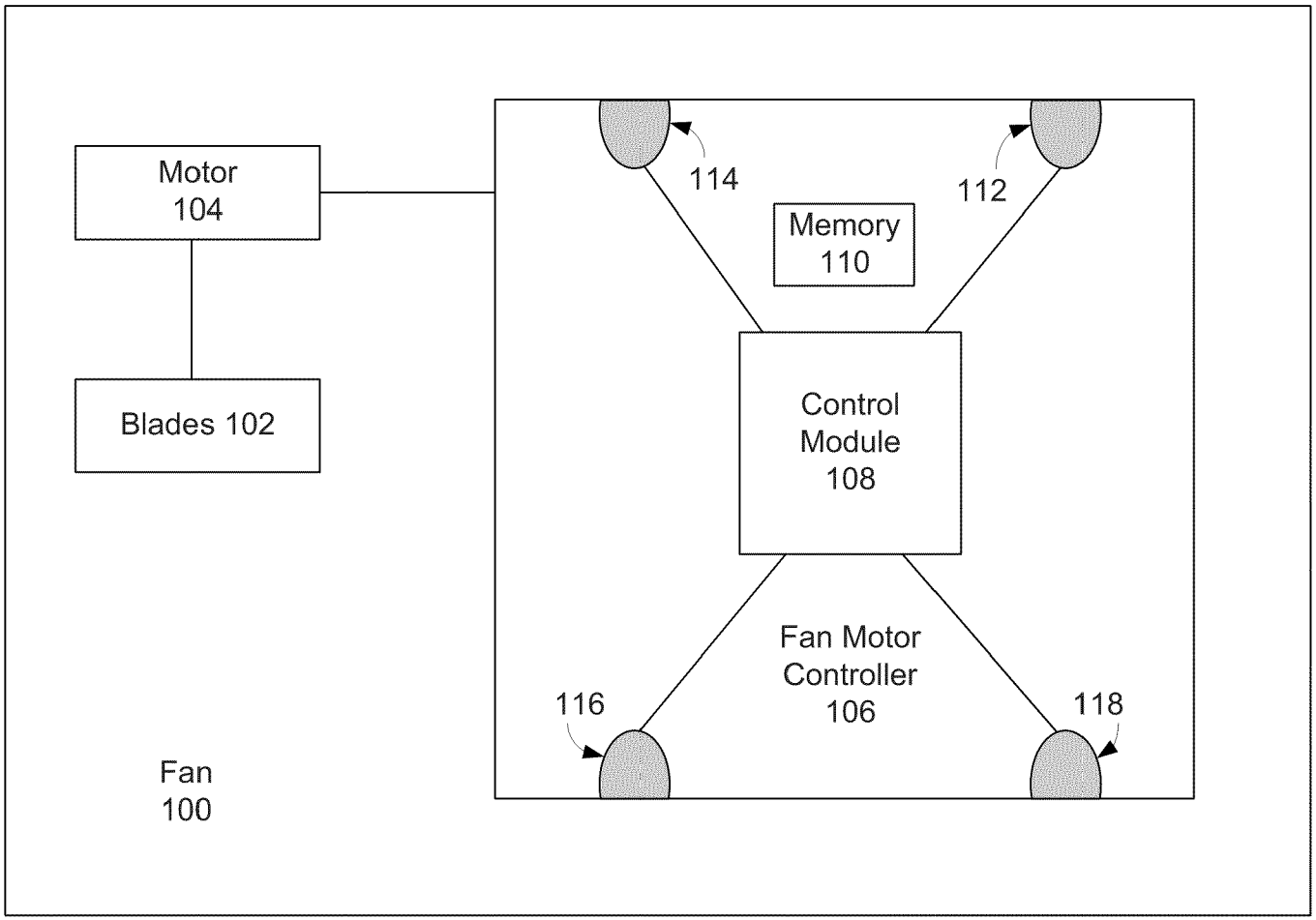
FIG. 1 schematically illustrates an exemplary cooling fan arrangement.

FIG. 1 schematically illustrates an arrangement for a cooling fan 100 for use within various electronic devices. The fan 100 includes a blade arrangement 102, a fan motor 104 coupled to the blade arrangement 102 in order to spin the blade arrangement 102, and a fan motor controller 106 communicatively coupled to the fan motor 104 in order to control the fan motor 104.

The fan motor controller 106 is generally an electrical device such as a semiconductor chip or a printed circuit board (PCB). The fan motor controller 106 generally includes a control module 108, which may be in the form of a semiconductor device if the fan motor controller 106 itself is a PCB. The fan motor controller 106 also includes memory 110. In the embodiment in which the fan motor controller 106 is in the form of a PCB, the memory 110 is generally included on the PCB, and may also be included in the same semiconductor device as the control module 108. In an embodiment in which the fan motor controller 106 is a semiconductor device, the memory 110 may be included within the semiconductor device that includes the control module 108. Alternatively, the memory 110 may itself be a separate semiconductor device that may be included separate from or within a package that includes the semiconductor device that includes the control module 108. In accordance with various embodiments, the memory 110 may be in the form of one-time programmable (OTP) memory. Depending upon the application, the fan motor controller 106 may include multiple OTP memories.

In accordance with the various embodiments, at least three "pins" 112, 114 and 116 are provided for electrically coupling the fan 100, and thereby the fan motor controller 106, to an electronic device (not shown) that will utilize the fan 100 within its cooling system. The first pin 112 provides the power input to the fan 100 and therefore is generally referred to as the $V_{dd}$ pin. The second pin 114 provides coupling of the fan 100 to reference ground and therefore is referred to as the Gmd pin, while the third pin 116 is referred to as the monitor pin. Often the monitor pin 116 is utilized to output signals from the fan 100 to the control system of the electronic device within which the fan 100 is housed. Thus, another name for the monitor pin 116 is a "fault output" pin. Often, such a pin arrangement is referred to as a "three-wire" control for fan motors. This is due to the fact that generally wires are coupled to the pins 112, 114 and 116, which are then coupled to the appropriate connections within the electronic device that houses the fan 100.

In accordance with various embodiments, the monitor pin 116 is continually monitored by the control module 108. If the output state of the monitor pin 116 is different from what is expected from the internal driving of the fan motor controller 106, this indicates to the control module 108 an external driving of the monitor pin 116, thereby indicating that an external system is attempting to communicate via the monitor pin 116. Once a particular pre-determined pattern is driven and detected on the monitor pin 116, the control module 108 recognizes this pre-determined pattern as a mode command that is requesting to change the operating protocol of the fan motor controller 106 with respect to the monitor pin 116 to a one-wire serial port communication protocol. The control module 108 will then convert the monitor pin into a one-wire communication pin. Examples of one-wire serial port communication protocols include Simple Serial Transport (SST). Use of a pre-determined pattern for the command to switch the fan motor controller 106 to the serial port communication protocol prevents spurious noises from triggering the fan motor controller 106 into the serial port communication protocol accidentally. Thus, the predetermined pattern is a unique pattern.

Once the fan motor controller 106 is in the serial port communication protocol, the memory 110 can be programmed via the control module 108 as desired for various operating parameters for the fan 100. The control module 108 receives the programming from an external system (not shown), such as, for example, some type of computing device. For example, a minimum rounds per minute (RPM) for the fan motor 104 can be programmed into the memory 110 along with a maximum RPM for the fan motor 104. Additionally, a speed versus temperature relationship may also be programmed into the memory 110. Such a parameter may provide a relationship that helps control the speed of the fan motor 104 based upon the temperature of the components within the electronic device that houses the fan 100. Thus, for example, the parameters may be programmed into memory 110 that control operation of the fan 100 such that once a pre-determined temperature is reached, the fan motor 104 will operate at the minimum RPM to begin cooling of the electronic device that houses the fan 100. As the temperature increases, the fan motor 104 will operate at greater RPMs until the maximum RPM is reached. As the temperature decreases, the fan motor speed will also correspondingly decrease until the temperature of the components within the electronic device reach or drop below the pre-determined temperature. The rate of change of the fan motor speed may be gradual or stepped depending upon the programming.

As previously noted, in accordance with various embodiments, the parameters are programmed into the memory 110 and the memory 110 may be in the form of OTP memory, which is generally more cost effective as compared to other types of memory. This is especially beneficial since the programming of the memory 110 can be performed at the end of production based upon customer specifications, and even after completion of production of the fan 100 according to customer specifications. The programming may also be performed by a manufacturer of an electronic device that installs the fan 100 into the electronic device. In such an instance, the manufacturer of the electronic device can program the memory with desired operating parameters based upon the electronic device specifications.

In accordance with various embodiments, other types of memory can be used to allow for changing of operating parameters of the fan 100 by a user of the electronic device that houses the fan. Thus, based upon changing use and applications of the electronic device, the user can alter the operating parameters of the fan 100 as desired. Alternatively, multiple OTP memories may be included to allow for a user of the electronic device to alter programming at a later time.

In accordance with various embodiments, once the programming of the memory 110 is completed and the serial port communication protocol is no longer needed, the fan motor controller 106 may be switched to another operating mode by issuing a serial port command from the external system (not shown) to the fan motor controller 106.

In accordance with various embodiments, a control/pulse width modulation (PWM) pin 118 may also be included on the fan motor controller 106. Such an arrangement allows for "four-wire" control for the fan motor 104. In such an embodiment, either the monitor pin 116 or the control/PWM pin 118 is continuously monitored for the command in the form of a particular pre-determined pattern that serves as the command to change the operating mode of the fan motor controller 106 to a serial port communication protocol. If a single wire serial port communication protocol is desired, then either the monitor pin 116 or the control/PWM pin 118 can be used. However, with the inclusion of the control/PWM pin 118, a two-wire serial port communication mode is possible. For a two-wire serial port communication protocol, the control/PWM pin 118 can be used as a data pin while the monitor pin 116 can be used as a serial clock pin. However, the pins 116 and 118 may be interchangeably reversed depending upon design choices and thus, the control/PWM pin 118 can be used as the serial clock pin, while the monitor pin 116 can be used as the data pin. Examples of two-wire serial port communication protocols include $I^2C$ and SMBus, which is also a subset $I^2C$.

Figure 2:
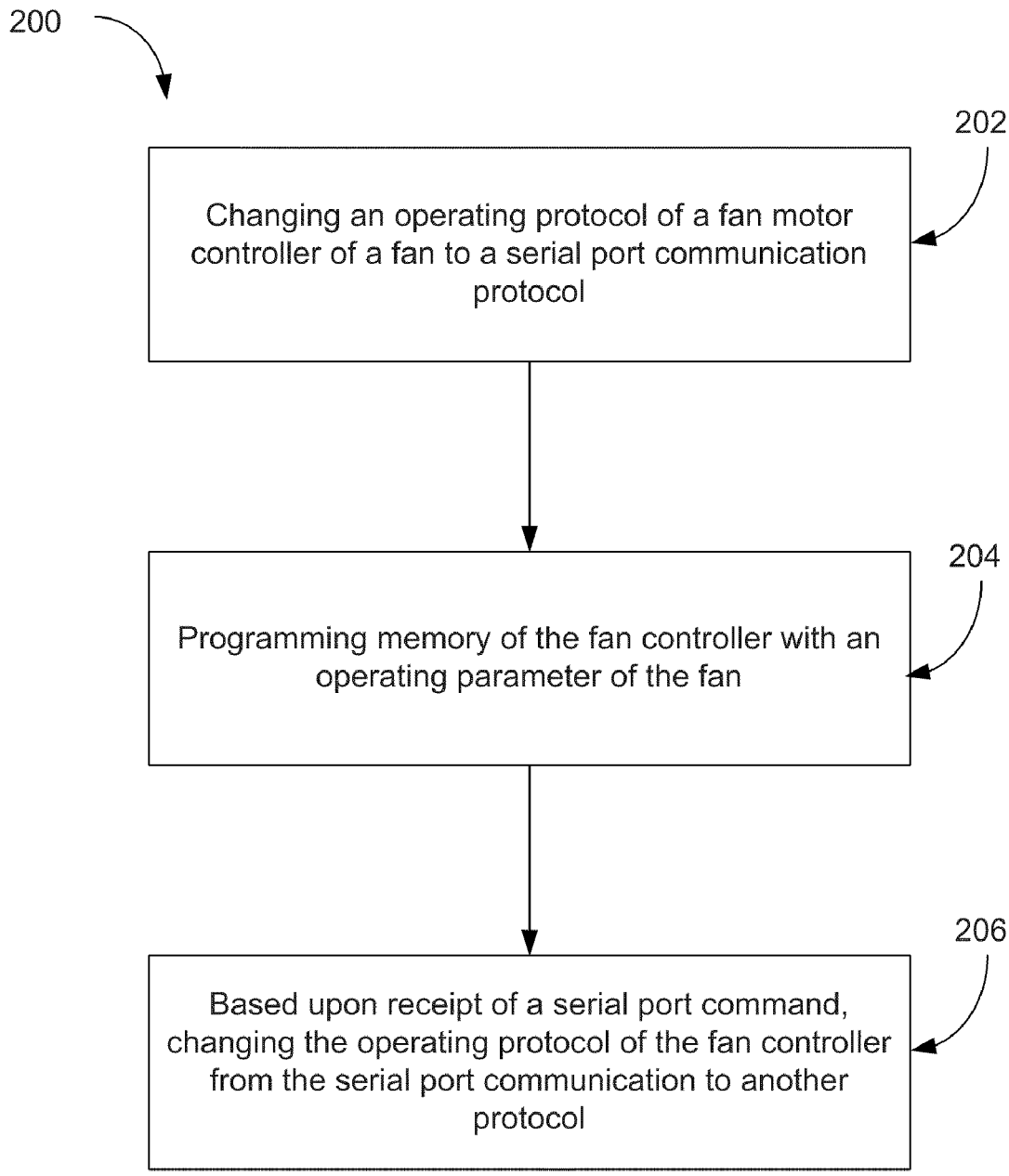
FIG. 2 is a block diagram of a method of programming the cooling fan arrangement of FIG. 1.

Referring to FIG. 2, a method 200 includes, at 202, changing an operating protocol of a fan motor controller to a serial port communication protocol. At 204, memory of the fan motor controller is programmed with one or more operating parameters of the fan. At 206, based upon receipt of a serial port command, the operating protocol of the fan motor controller is changed from the serial communication protocol to another protocol. In accordance with various embodiments, multiple operating parameters of the fan are programmed into the memory.

Although certain embodiments have been illustrated and described herein, a wide variety of alternate and/or equivalent embodiments or implementations calculated to achieve the same purposes may be substituted for the embodiments illustrated and described without departing from the scope of the present disclosure. This application is intended to cover any adaptations or variations of the embodiments discussed herein. Therefore, it is manifestly intended that embodiments described herein be limited only by the claims and the equivalents thereof.

What is claimed is:

1. A method of programming a cooling fan arrangement, wherein the cooling fan arrangement includes (i) a fan, (ii) a fan motor, and (iii) a fan motor controller, and wherein the cooling fan arrangement is usable in various electronic devices, the method comprising:

monitoring a fault output pin of the cooling fan arrangement while in an initial operating mode, wherein the fault output pin is coupled to the fan motor controller for transmitting fault information from the cooling fan arrangement;

determining whether an output state of the fault output pin is different from what is expected from an internal driving of the fan motor controller;

in response to determining that the output state of the fault output pin is different from what is expected from an internal driving of the fan motor controller, detecting a pre-determined pattern in the fault output pin;

recognizing the pre-determined pattern as a mode command received from an external system;

in response to recognizing the pre-determined pattern as the mode command, changing an operating mode of the fan motor controller to a serial port communication protocol to receive external programming;

programming a memory, via the external system, of the fan motor controller with an operating parameter of the cooling fan arrangement, wherein the operating parameter is related to an electronic device that either (i) will house the cooling fan arrangement, or (ii) houses the cooling fan arrangement; and based upon receipt of a serial port command, changing the operating mode of the fan motor controller from the serial port communication protocol back to the protocol of the initial operating mode, wherein the electronic device is different from the external system.

2. The method of claim 1, wherein:

the cooling fan arrangement comprises a three-wire control arrangement; and the serial port communication protocol is a one-wire serial port communication protocol.

3. The method of claim 1, wherein:

the fan comprises a four-wire control arrangement; and the serial port communication protocol is a two-wire serial port communication protocol.

4. The method of claim 1, wherein the programming occurs during production of the cooling fan arrangement.

5. The method of claim 1, wherein the programming occurs subsequent to production of the cooling fan arrangement.

6. The method of claim 1, wherein the operating parameter is selected to configure performance of the cooling fan arrangement to accommodate the electronic device.

7. The method of claim 1, wherein the memory is one-time-programmable.

8. The method of claim 1, wherein the operating parameter includes a temperature parameter that controls the cooling fan arrangement to achieve a predetermined temperature.

9. The method of claim 1, wherein the operating parameter includes a rounds per minute parameter that controls a speed of the fan motor and thereby the fan.

10. An apparatus for use within a cooling fan arrangement, wherein the cooling fan arrangement can be used in various electronic devices, the apparatus comprising:

a memory; and a control module configured to monitor a fault output pin of the cooling fan arrangement while in an initial operating mode, wherein the fault output pin is coupled to the fan motor controller for transmitting fault information from the cooling fan arrangement, determine whether an output state of the fault output pin is different from what is expected from an internal driving of the fan motor controller, in response to determining that the output state of the fault output pin is different from what is expected from an internal driving of the fan motor controller, detect a pre-determined pattern in the fault output pin, recognize the pre-determined pattern as a mode command received from an external system, in response to recognizing the pre-determined pattern as the mode command, change an operating mode of the apparatus to a serial port communication protocol to receive external programming, program, via the external system, the memory with an operating parameter of the cooling fan arrangement, wherein the operating parameter is related to an electronic device that either (i) will house the cooling fan arrangement, or (ii) houses the cooling fan arrangement, and in response to receipt of a serial port command at the monitor pin, change the operating mode of the apparatus from the serial port communication protocol back to the protocol of the initial operating mode, wherein the electronic device is different from the external system.

11. The apparatus of claim 10, wherein;

the serial port communication protocol is a one-wire serial port communication protocol; and the control module is configured to utilize the monitor pin for the one-wire serial port communication protocol.

12. The apparatus of claim 10, further comprising;

a pulse width modulation (PWM) pin, wherein the serial port communication protocol is a two-wire serial port communication protocol, and wherein the control module is configured to utilize the monitor pin and the PWM pin for the two-wire serial port communication protocol.

13. The apparatus of claim 12, wherein, during the two-wire serial port communication protocol, the PWM pin is utilized as a data pin and the monitor pin is utilized as a serial clock pin.

14. The apparatus of claim 10, wherein the operating parameter includes a temperature parameter that controls the cooling fan arrangement to achieve a predetermined temperature.

15. The apparatus of claim 10, wherein the operating parameter includes a rounds per minute parameter that controls a speed of a fan included within the cooling fan arrangement.

16. The apparatus of claim 10, wherein the control module is configured to program multiple operating parameters of the cooling fan arrangement into the memory.

17. The apparatus of claim 10, wherein the memory is one-time-programmable.

* * * * *